US006540114B1

(12) United States Patent
Popovich et al.

(10) Patent No.: US 6,540,114 B1
(45) Date of Patent: Apr. 1, 2003

(54) DUAL TAMPER EVIDENT DISPENSING CLOSURE

(75) Inventors: John Popovich, New Castle, PA (US); Mark Clause, New Castle, PA (US); Michael Marino, deceased, late of New Castle, PA (US), by Susan L. Farrell, executrix

(73) Assignee: West Penn Plastic, Inc., New Castle, PA (US)

( * ) Notice: Subject to any disclaimer, the term of this patent is extended or adjusted under 35 U.S.C. 154(b) by 0 days.

(21) Appl. No.: 09/879,620

(22) Filed: Jun. 13, 2001

(51) Int. Cl.[7] ..... B67D 5/32

(52) U.S. Cl. ..... 222/153.02; 222/153.06; 222/543; 215/252; 215/258

(58) Field of Search ..... 222/153.02, 153.06, 222/543; 215/252, 250, 258, 253, 256, 255, 375, 265, 266

(56) References Cited

U.S. PATENT DOCUMENTS 4,090,647 A * 5/1978 Dunning ..... 222/543
5,588,562 A * 12/1996 Sander et al. ..... 215/252
5,657,905 A * 8/1997 Glynn ..... 215/216
5,711,453 A * 1/1998 Weiler ..... 222/541.2
5,829,611 A * 11/1998 Beck ..... 215/252
5,975,369 A * 11/1999 Yurkewicz et al. ..... 215/251
6,050,452 A * 4/2000 Pradinas ..... 222/153.02
6,095,375 A * 8/2000 Adams et al. ..... 156/107
6,247,616 B1 * 6/2001 Weiler et al. ..... 222/541.2

* cited by examiner

*Primary Examiner*—Gene Mancene
*Assistant Examiner*—Stephanie Willatt
(74) *Attorney, Agent, or Firm*—Harpman & Harpman

(57) ABSTRACT

A dual tamper evident container closure for a dispensing container, the cap portion being of a type intended to be held permanently captive on the container having a nozzle dispensing opening, multiple sealing flanges and dual locking engagement beads to retain the cap portion on the container. The closure portion is registerable over the dispensing opening and retained to the cap portion by a flexible web. Both the cap portion and the closure portion have depending interconnected frangible bands that engage and are retained on the respective container and nozzle to indicate prior opening or tampering with the container closure.

7 Claims, 5 Drawing Sheets

DUAL TAMPER EVIDENT DISPENSING CLOSURE

BACKGROUND OF THE INVENTION

1. Technical Field

This device relates to tamper indicating closures for dispensing containers that utilize a removable attached locking closure permanently secured to the cap for selective removal and replacement.

2. Description of Prior Art

Prior art devices of this type are directed to resealable closures for containers in which the cap portion is held permanently captive on the dispensing container. Closures of this type have generally relied on integral synthetic resin molded configurations having a container engagement portion defining its dispensing spout and a sealing closure portion secured on the end of a flexible web that is frictionally engaged over the dispensing spout. Examples of such closure configurations can be seen in U.S. Pat. Nos. 3,113,693, 3,227,332, 3,877,598 and 4,281,778.

In U.S. Pat. No. 3,113,693 a multiple position snap cap can be seen wherein a container neck has a stopper member on a connective web that is removably secured with the neck opening.

U.S. Pat. No. 3,227,332 illustrates a captive closure in which one form of the invention has an over cap secured on the end of a retaining strap engaged around a spout within the container engagement portion.

A closure having a child safety feature is disclosed in U.S. Pat. No. 3,877,598 wherein a container engagement base portion defines a dispensing opening therein. An over closure cap extends from the base on a strap for sealing relation therewith.

U.S. Pat. No. 4,281,778 on a locking closure cap has a container engagement base portion with an integral pour spout. A closure cap is registerable over the spout and is attached to the base portion by a connecting web.

SUMMARY OF THE INVENTION

A dual tamper evident resealable closure for containers that require multiple tamper evident configurations. A first tamper evident band on the cap base portion that engages the container neck. A second tamper evident configuration on the resealable locking closure is registerable over a pour spout formed within the cap base portion.

DESCRIPTION OF THE PREFERRED EMBODIMENTS

Figure 1:
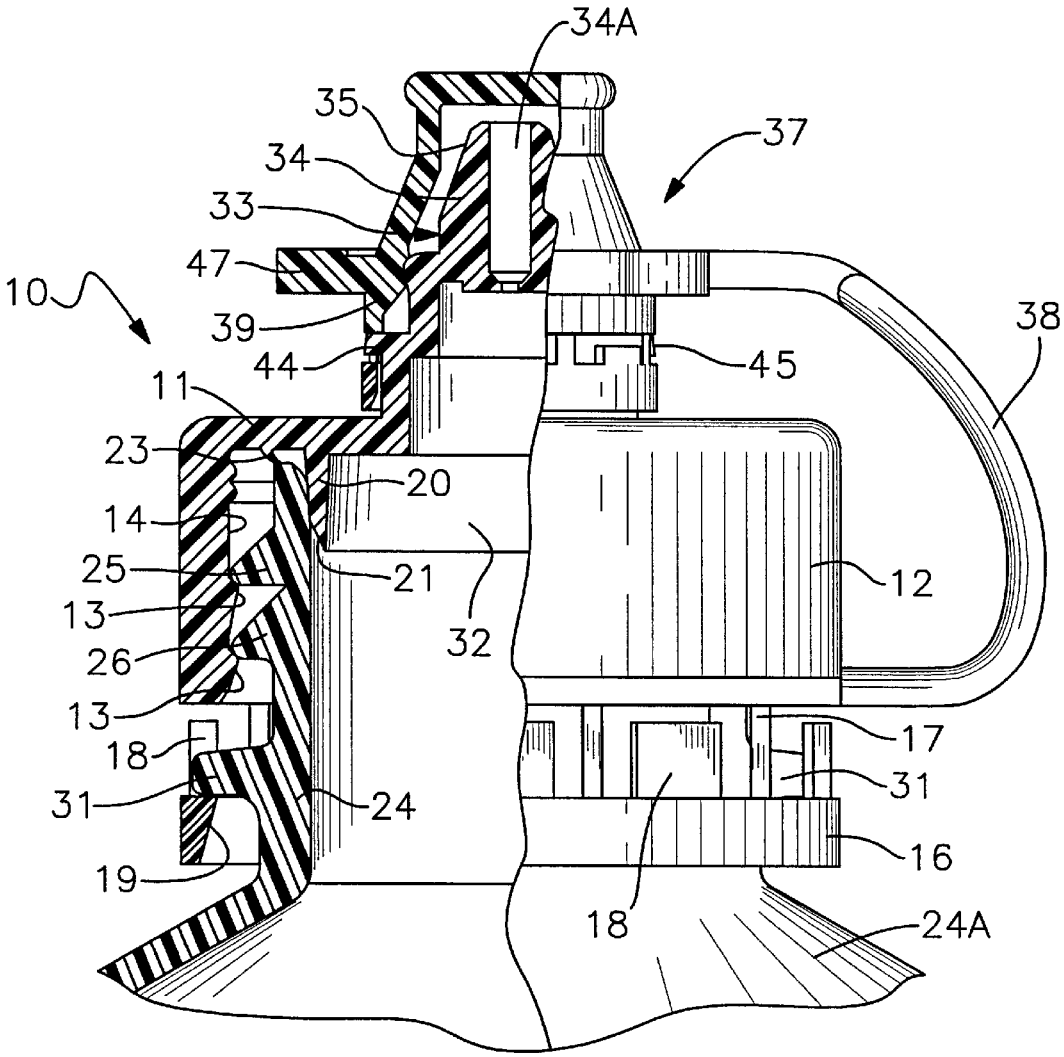
FIG. 1 is an enlarged partial cross-sectional view of the dispensing closure cap on a bottle.
Figure 2:
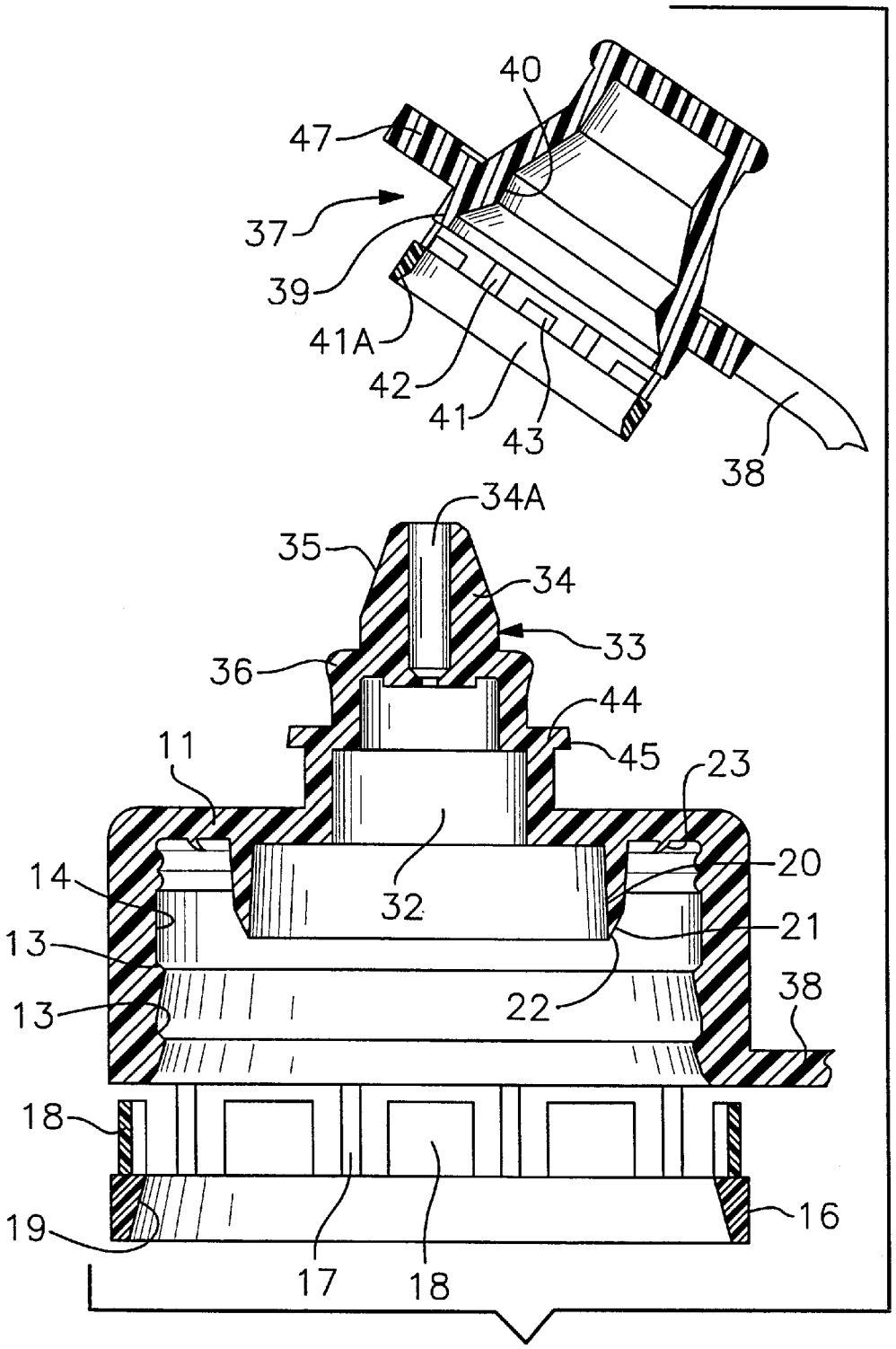
FIG. 2 is an enlarged cross-sectional view of the dispensing closure cap in open position.
Figure 3:
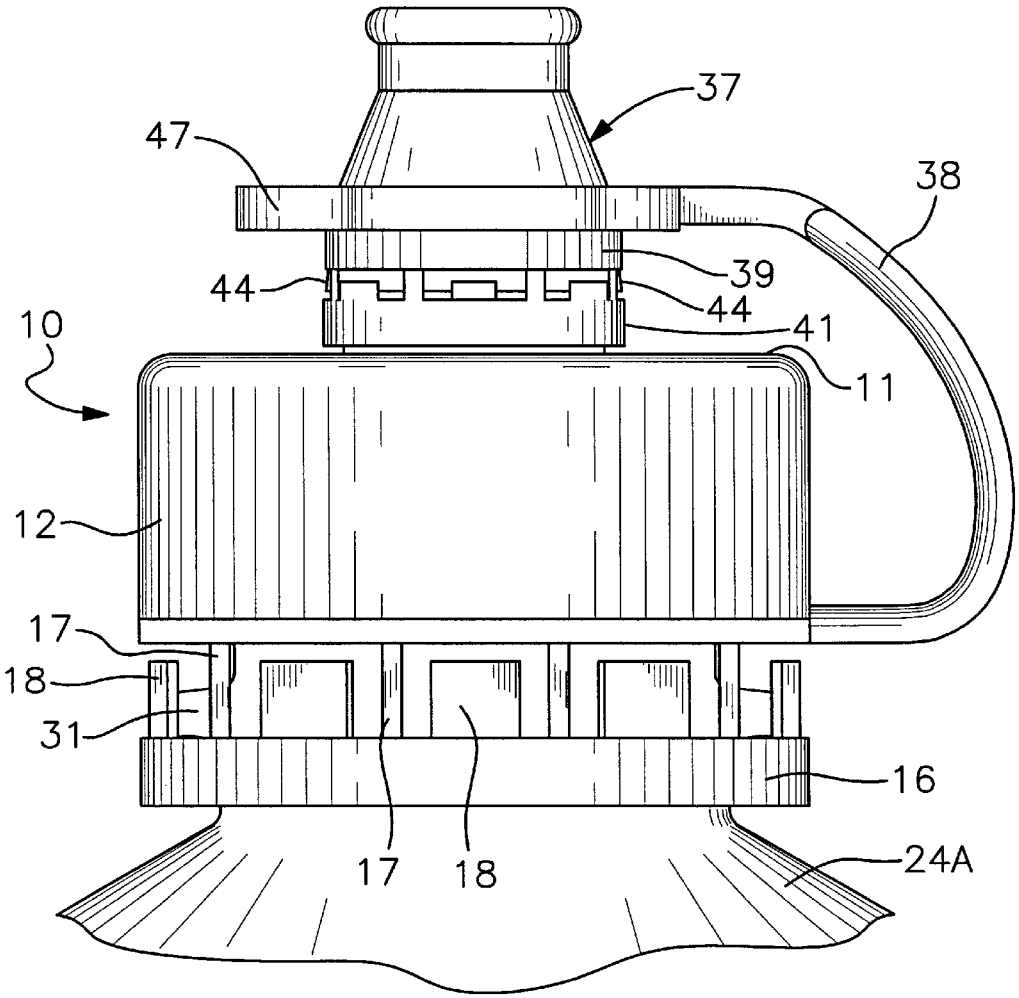
FIG. 3 is an enlarged side elevational view of the dispensing closure cap in closed sealed position.

Referring to FIGS. 1 and 2 of the drawings, it will be seen that a cap 10 is shown having a top portion 11 with a depending annular skirt 12 extending therefrom. The skirt 12 has a pair of vertically spaced annular parallel engagement beads 13 formed on its inner surface 14. A frangible annular ring 16 extends from and is integrally molded to the depending skirt 12 by a plurality of interconnecting frangible elements 17 extending therebetween. The ring 16 has a plurality of upstanding engagement spacers 18 inner disposed between the respective frangible elements 17. The ring 16 has a tapered configuration defined by a tapered inner wall surface 19.

The top portion 11 has a first annularly pending plug seal flange 20 spaced inwardly of the dispensing skirt 12 with a tapered outer surface portion 21 extending from its free end 22. An annular claw-sealing flange 23 depends angularly from the inner surface of the top portion 11 between the skirt 12 and the hereinbefore-described plug-sealing flange 20.

Figure 5:
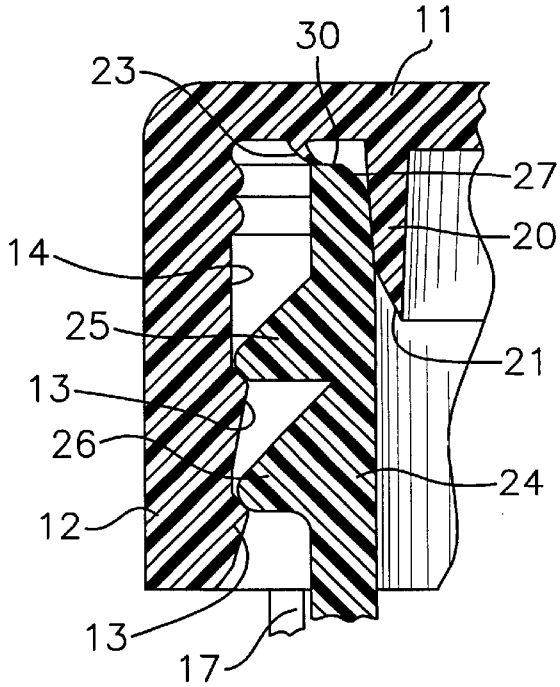
FIG. 5 is an enlarged partial sectional view of an inner engagement sealing elements of the dispenser cap engaged on a neck portion of a container.

Referring now to FIGS. 1 & 5 of the drawings, a neck 24 of a container 24A can be seen having a pair of vertically spaced annular cap engagement flanges 25 and 26 extending outwardly therefrom. The engagement flanges 25 and 26 are registerable within the respective engagement beads 13 on the dispensing skirt 12.

Referring to FIG. 5 of the drawings, the neck 24 can be seen engaged within the closure cap 10 of the invention. The neck 24 has a tapered inside surface portion 27 extending inwardly from its free end portion 28. The depending plug seal flange 20 forms a first seal against an inner wall 29 of the neck 24. The angularly disposed claw seal flange 23 defines a second seal against an edge portion 30 of the neck 24 being deformed by engagement therewith.

Referring back to FIG. 1 of the drawings, the neck 24 has an annular cap retaining flange 31 extending outwardly therefrom in spaced relation to said cap engagement flanges 25 and 26 as hereinbefore described. The frangible ring 16 engages and is retained on the neck 24 by the cap-retaining flange 31 so that if the closure cap 10 is removed it will break the frangible elements 17 as illustrated by break lines thereon.

Referring now to FIG. 2 of the drawings, an opening 32 is formed in the center of the top portion 11 of the cap 10 with an upstanding cylindrical dispensing spout 33 positioned in registration communication with the opening 32. The dispensing spout 33 has a nozzle portion 34 with a dispensing orifice 34A. The nozzle portion 34 has a conical upper outer surface 35 with an annular closure retaining shoulder 36 on its base.

A nozzle closure 37 is cooperative with the nozzle portion 34 and is connected to the depending skirt 12 by means of a flexible web 38. The nozzle closure 37 is adapted to be selectively registerable over the nozzle portion 34 and retained thereon covering the dispensing orifice 34A. The nozzle closure 37 includes a dispensing sealing skirt 39 having an internal annular groove 40 which forms a primary seal with the closure retaining shoulder 36 as best seen in FIG. 1 of the drawings when the nozzle closure is closed.

A second frangible ring 41 is integrally molded to the depending sealing skirt 39 by a plurality of interconnected spaced frangible elements 42 extending therebetween. The second frangible ring 41 also has a plurality of upstanding engagement spacers 43 inner spaced respectively between said respective secondary frangible elements 42. The secondary frangible ring 41 has an inner tapered surface portion 41A which aids with the initial positioning on the nozzle portion 33 by passing engagement with an annular retaining flange 44 extending from the outer surface of the dispensing sealing skirt 39. The retaining flange 44 has a corresponding tapered perimeter edge 45 for passing registration with the second frangible ring 41 that must be deformed to pass thereover as is well known by those skilled in the art.

It will be evident from the above description that once the frangible ring 41 is positioned below the retaining flange 44, it will engage same and thus provide indication of initial removal of the nozzle closure 37 which will require the separation of the frangible elements from the skirt 39 as hereinbefore described.

Figure 4:
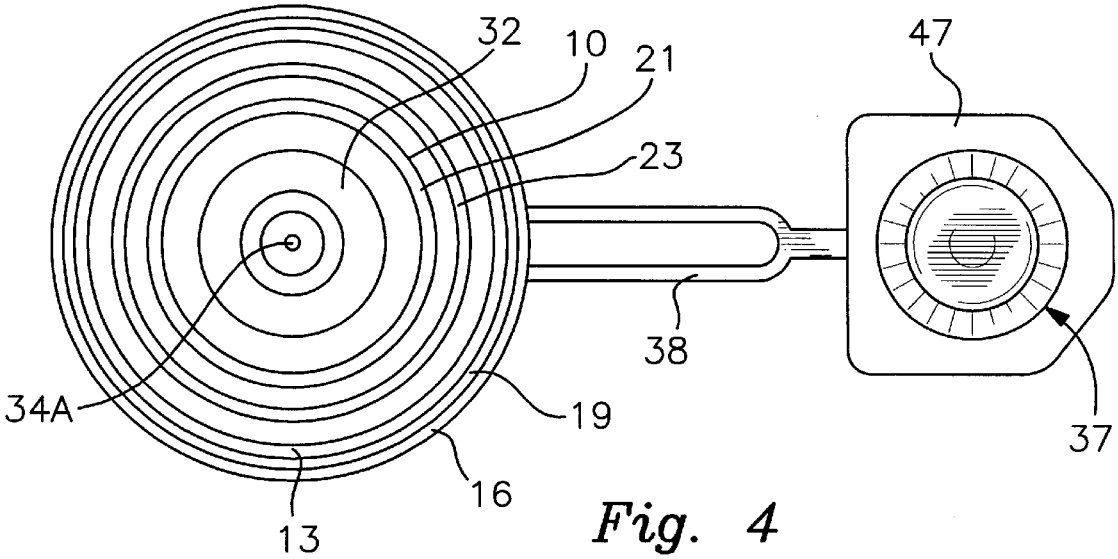
FIG. 4 is a bottom plan view of the dispensing closure cap in open position.
Figure 6:
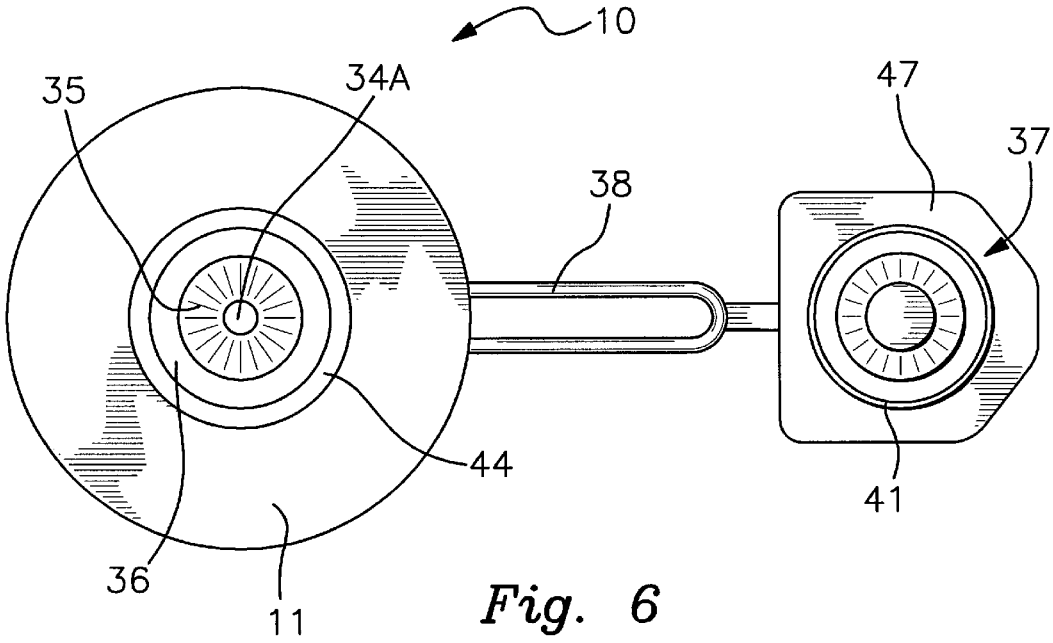
FIG. 6 is a top plan view of the dispensing closure cap of the invention in open position.

The nozzle closure 37 has a finger engageable lift tab 47 extending thereabout that is integral with the web 38 as best seen in FIGS. 4 and 6 of the drawings which aids in the initial removal of the nozzle closure 37 as well as the subsequent removals upon resealing same over the nozzle spout 33.

It will be evident from the above description that by combining the unique tamper evident rings 16 and 41 in combination with a double internal seal of the claw flange 23 and plug flange 20 on the neck 24 of the container 24A that an improved tamper evident closure cap has been illustrated and described and it will be apparent to those skilled in the art that various changes and modifications may be made therein without departing from the spirit of the invention.

We claim:

1. A dual tamper evident closure for a dispensing container, said container having a neck portion, said closure adapted to be primarily secured to the neck portion of said container and container having a resealable dispensing outlet comprises in combination a. a resilient molded synthetic resin cap body having a top portion, a first annular depending skirt extending therefrom b. said first skirt provided with internal annular contoured engagement beads, c. a first tamper indicating ring extending from said first depending skirt by a plurality of circumferentially spaced frangible elements, d. a plurality of annularly spaced upstanding elevated bridge portions on said first ring between said respective frangible elements in spaced relation to said first depending skirt, e. an upstanding dispensing nozzle extending from a central aperture in said top portion having a dispensing orifice within, f. a first annular sealing flange depending from said top portion engageable on an inner surface of said neck portion, g. a second annular sling flange depending from said top portion in spaced relation to said first sealing flange and said depending skirt, said first and second sealing flanges constituting leak resistant seals with said container, h. a nozzle engagement closure having a second depending skirt, i. a second tamper indicating ring connected to said second depending skirt by a plurality of radially spaced frangible elements, j. radially spaced upstanding bridge portions on said second tamper indicating ring between said respective frangible elements, k. cooperable retainer means on said nozzle engagement closure skirt for resealably retaining the nozzle closure in a position overlying the dispensing orifice, l. flexible interconnecting means extending between said nozzle closure and said annular depending cap body skirt, m. said first annular sealing flange of a known length and said second annular sealing flange of a length less than that of said first sealing flange.

2. The dual tamper evident closure set forth in claim 1 wherein said first tamper indicating ring has a tapered inner surface adapted to bypass a retaining flange on said container.

3. The dual tamper evident closure set forth in claim 1 wherein said elevated bridge portions on said first and second tamper indicating rings extend integrally therefrom in spaced relation to said respective cap body's and said nozzle engagement closure depending skirts.

4. The dual tamper evident closure set forth in claim 1 wherein said internal annular container engagement beads on said dispensing cap body skirt are adapted to registerably engage with respective annular cap engagement flanges extending from said container.

5. The dual tamper evident closure set forth in claim 1 wherein said nozzle engagement closure has a generally conical cross-section.

6. The dual tamper evident closure set forth in claim 1 wherein said cooperable retainer means on said nozzle engagement closure skirt for resealably retaining the nozzle closure in position overlying the dispensing nozzle comprises, a closure retaining shoulder on said cap nozzle, and an internal annular groove on said closure body registerable therewith.

7. A dual tamper evident closure for a dispensing container, said container having a neck portion, said closure adapted to be primarily secured to the neck portion of said container and container having a resealable dispensing outlet comprises in combination a. a resilient molded synthetic resin cap body having a top portion, a first annular depending skirt extending therefrom b. said first skirt provided with internal annular contoured engagement beads, c. a first tamper indicating ring extending from said first depending skirt by a plurality of circumferentially spaced frangible elements, d. a plurality of annularly spaced upstanding elevated bridge portions on said first ring between said respective frangible elements in spaced relation to said first depending skirt, e. an upstanding dispensing nozzle extending from a central aperture in said top portion having a dispensing orifice within, f. a first annular sealing flange depending from said top portion engageable on an inner surface of said neck portion, g. a second annular sealing flange depending from said top portion in spaced relation to said first sealing flange and said depending skirt, said first and second sealing flanges constituting leak resistant seals with said container, h. a nozzle engagement closure having a second depending so, i. a second tamper indicating ring connected to said second depending skirt by a plurality of radially spaced frangible elements, j. radially spaced upstanding bridge portions on said second tamper indicating ring between said respective frangible elements, k. said first and second frangible rings having inner tapered surfaces adapted to bypass respective annular retaining flanges extending from respective container and dispensing nozzle.

l. flexible interconnecting means extending between said nozzle closure and said annular depending cap body skirt, m. said fist and second annular sealing flanges are tapered for yieldable engagement against a cap engageable neck portion of said container, n. said first and second tamper indicating rings have inner tapered surfaces adapted to bypass respective annular retaining flanges on said container and said dispensing nozzle.

* * * * *